US008813952B2

(12) United States Patent
Campbell

(10) Patent No.: US 8,813,952 B2
(45) Date of Patent: Aug. 26, 2014

(54) CONTAINER LIMITING DRYING OF PAINT

(76) Inventor: Wayne E. Campbell, Flat Rock, IN (US)

( * ) Notice: Subject to any disclaimer, the term of this patent is extended or adjusted under 35 U.S.C. 154(b) by 168 days.

(21) Appl. No.: 13/556,585

(22) Filed: Jul. 24, 2012

(65) Prior Publication Data

US 2014/0027316 A1 Jan. 30, 2014

(51) Int. Cl.
*B44D 3/02* (2006.01)

(52) U.S. Cl.
USPC ..... 206/1.8; 206/1.7; 206/213.1

(58) Field of Classification Search
USPC ..... 206/1.7, 1.8, 1.9, 423, 204, 213.1
See application file for complete search history.

(56) References Cited

U.S. PATENT DOCUMENTS

| | | | | | |
|---|---|---|---|---|---|
| 2,719,660 | A | * | 10/1955 | Ellis | 53/431 |
| 3,336,093 | A | * | 8/1967 | Phelps | 312/31.1 |
| 3,885,843 | A | | 5/1975 | Rubel | |
| 4,279,350 | A | | 7/1981 | King | |
| 4,667,814 | A | | 5/1987 | Wakamatsu et al. | |
| 5,555,974 | A | | 9/1996 | Donald et al. | |

* cited by examiner

*Primary Examiner* — David Fidei
(74) *Attorney, Agent, or Firm* — Woodard, Emhardt, Moriarty, McNett & Henry LLP

(57) ABSTRACT

A container for holding an item having un-dried, oil-based paint thereon. A box has a removable lid with an outlet hole. The lid extends horizontally across and then upwardly on the container defining a first area to hold the item and a second area to hold a container of material when activated by a liquid to give off a gas heavier than oxygen. The oxygen is forced through the outlet hole limiting drying of paint on the item.

14 Claims, 4 Drawing Sheets

CONTAINER LIMITING DRYING OF PAINT

BACKGROUND OF THE INVENTION

1. Field of the Invention

The present invention relates generally to the field of containers for holding palettes or other items which limit the drying of paint thereon.

2. Description of the Prior Art

An artist typically applies different colored paints to a palette from tubes of paint. The artist then transfers the paint from the palette to the painting which may take several days to complete. The paint placed on the palette is subjected to drying over a period of time and thus the artist is required to apply additional amounts of the same color to the palette. The paint is quite expensive thereby adding to the overall cost of the paint utilized to complete the work. In certain cases, the paints applied to the palette may consist of a number of different colored paints mixed together thereby providing a unique color. Once the combination of paints has been applied to the palette and the resultant combination dries, it becomes difficult for the artist to arrive at the same color combination in order to complete the work. The solution of the problem has been to provide containers that enclose the palette in an air tight space minimizing the drying of the paint.

One such enclosure for storing a palette having an oxygen scavenging material is disclosed in U.S. Pat. No. 5,555,974. Within the enclosure is provided a packet of oxygen scavenging material for preventing polymerization of the oil based paint on the palette. An oxygen absorbent packet is disclosed in U.S. Pat. No. 4,667,814. An alternate approach is disclosed in U.S. Pat. No. 3,885,843 wherein a humidifier for a palette includes a plastic container to create a moist and lowered temperature atmosphere within the storage compartment for preventing the paints from untimely drying and hardening during and between uses. Another approach is disclosed in U.S. Pat. No. 4,279,350 wherein the system uses a liner and incorporates a catalyst disposed between an oxygen permeable barrier and a water absorbent backing member. The closure may be perforated to allow the water to escape. Despite the prior approaches, the paint on palettes continue to dry with no ultimate solution provided to the aforementioned problem.

When a palette is placed within an enclosure, the enclosure typically includes air which includes oxygen gas as its major constituent. The oxygen within the air is the principal agent that causes the paint to dry on the palette. Thus, some of the prior art devices utilize oxygen scavenging methods. The prior art devices typically utilize specially constructed packets of material to scavenge the gas from within the palette container. As these specially ordered materials are used, there is a need for replenishment requiring special ordering thereof. The device disclosed herein utilizes common household materials thereby facilitating the ease of replenishment thereof.

Disclosed herein is a further approach that obtains superior results by minimizing the oxygen within the enclosure holding the palette. Oxygen is driven from the enclosure by a heavier gas that results from activation of materials placed within the enclosure.

Likewise, it is desirable to prevent oil based paint from drying on other works, such as sculptures, etc., while the work is in the process of being completed. Thus, the present container may be used for holding any item while limiting the paint from drying.

SUMMARY OF THE INVENTION

One embodiment of the present invention is a container for holding an item and limiting drying of paints on the item. The container has a main body for holding the item with paints thereon. A lid is mounted to the main body forming a container to store the item therein with the container including an outlet to allow oxygen within the container to escape. A receptacle within the main body holds material when activated to give off a gas heavier than oxygen forcing oxygen out of the container via the outlet limiting solidification of paint on the item.

It is an object of the present invention to provide a new and improved container for holding a palette or other item while limiting drying of paints on the palette or other item during storage thereof.

A further object of the present invention is to provide an enclosure for holding a palette with paint thereon with oxygen within the enclosure being ejected from the enclosure.

A further object of the present invention is to provide an inexpensive and easy to use item container for minimizing drying of paint on the item.

Related objects and advantages of the present invention will be apparent from the following description.

DESCRIPTION OF THE PREFERRED EMBODIMENT

Figure 1:
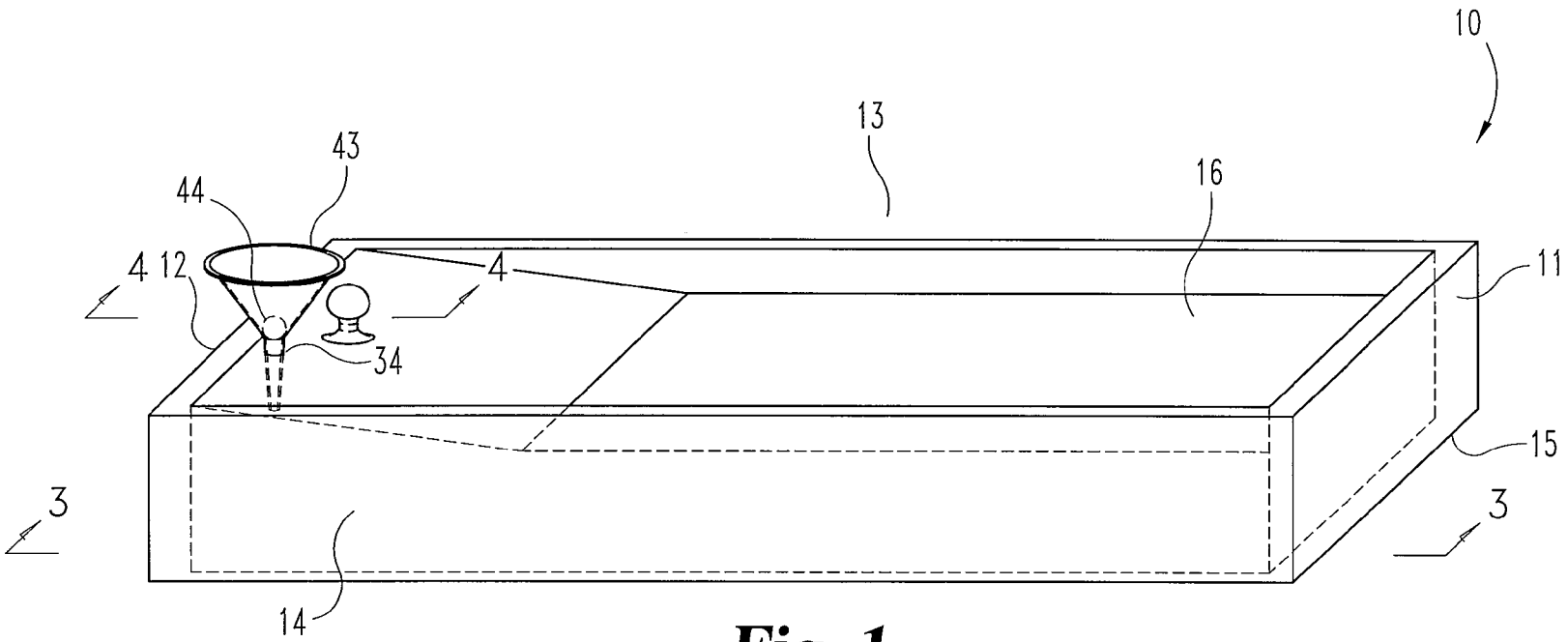
FIG. 1 is a side perspective view of the preferred embodiment of a container incorporating the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to the drawings, there is shown a container 10 for holding an artist palette and storing same in such a manner to limit the drying of oil-based paints on the palette. The container includes a main body having a pair of end walls 11 and 12 joined to a pair of side walls 13 and 14 in a generally rectangular configuration. The main body includes a bottom wall 15 joined to the end and side walls thereby providing a space into which the palette may be inserted. Lid 16 is mounted to the top of the main body thereby enclosing the palette storage space. In one embodiment, main body is constructed of a rigid material, such as wood or a rigid plastic, whereas, lid 16 is produced from a flexible plastic sheet.

Figure 2:
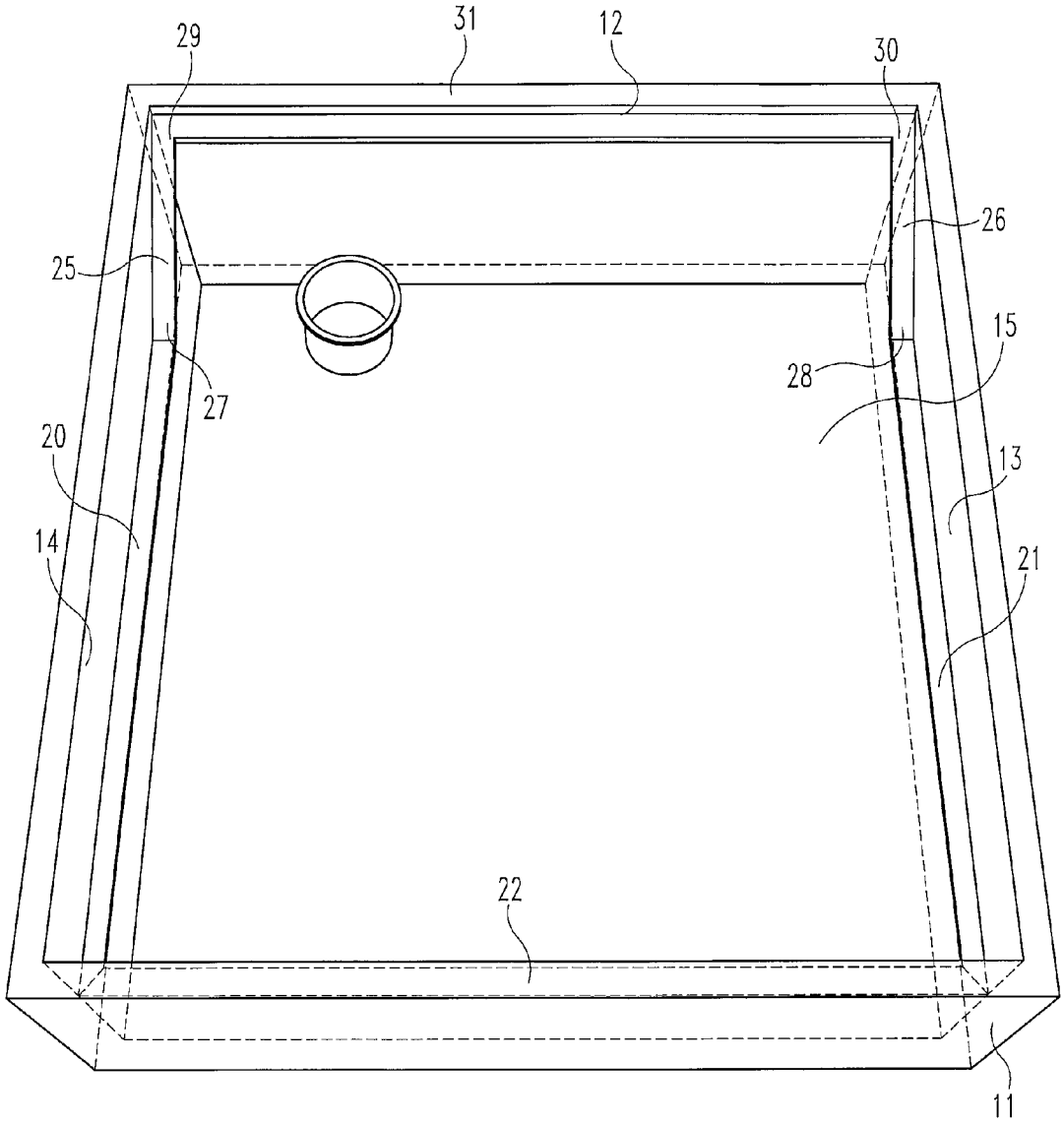
FIG. 2 is an end perspective view of the container of FIG. 1 with the lid removed.

The lid rests upon a pair of shelves 20 and 21 (FIG. 2) provided on the mutually facing surfaces of side walls 14 and 13 along with a third shelf 22 provided on the inwardly facing surface of end wall 11. Shelves 20-22 extend horizontally and parallel to the bottom wall 15 of the main body. A pair of upwardly inclined shelves 25 and 26 is provided on the mutually facing surfaces of side walls 14 and 13. Shelves 25 and 26 have bottom ends 27 and 28 respectively terminating adjacent the shelves 20 and 21. The top ends 29 and 30 of shelves 25 and 26 terminate adjacent the top edge 31 of end wall 12. An optional shelf may be provided on the inwardly facing surface of end wall 12 extending between ends 29 and 30 of shelves 25 and 26.

Figure 3:
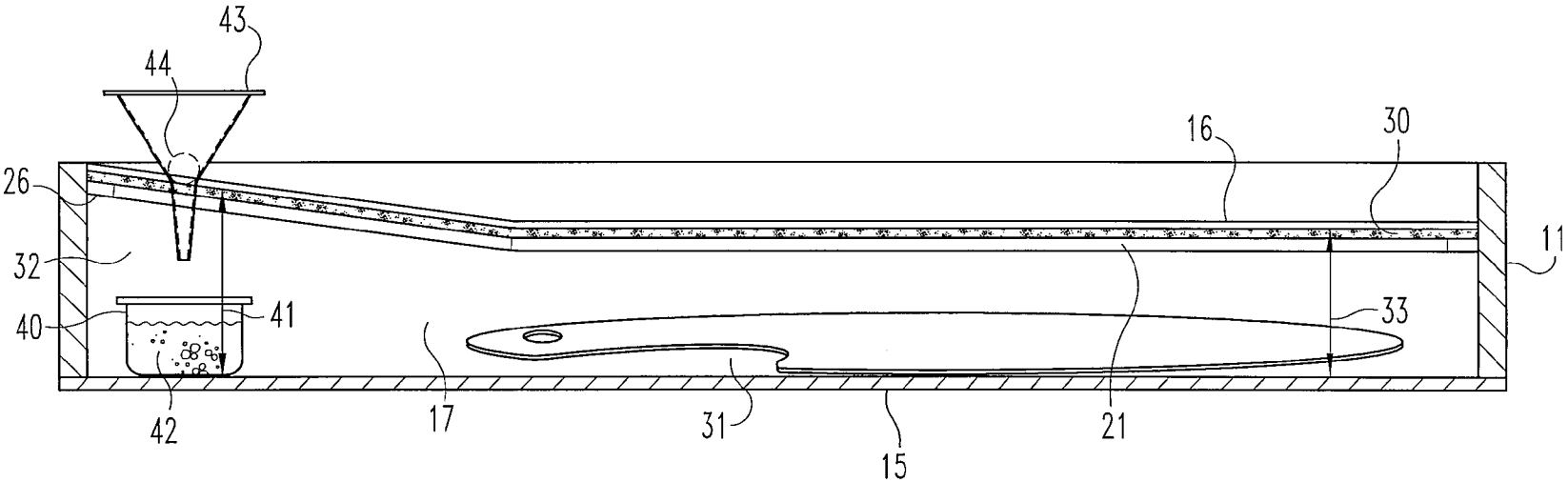
FIG. 3 is a cross-sectional view taken along a line and viewed in the direction of arrows 3-3 of FIG. 1.

A lid 16 (FIG. 1) is restable atop horizontal shelves 20, 21 and 22 and also atop the upwardly inclined shelves 25 and 26. Lid 16 is produced from a flexible sheet material, such as plastic. The lid extends horizontally on shelves 20-22 and then slopes upwardly at an acute angle relative to the horizontal as the lid extends atop shelves 25 and 26. A sectional view of the container with lid thereon is shown in FIG. 3. Lid 16 is shown resting atop shelf 21 as the shelf and lid extend horizontally with the lid then extending upwardly atop the inclined shelf 26. The bottom facing peripheral edge of the lid includes a flexible gasket 30 that is in contact with the lid and shelves 20-22 and 25-26. The gasket with the shelves plus the weight of the lid provide a sealing contact between the lid and the enclosed space 17 (FIG. 3) between the main body of the container and the lid creating a gas tight environment within space 17 except through outlet 34.

The storage space 17 includes two distinct areas. First, area 31 is located between the horizontally extending lid 16 and the horizontally extending bottom wall 15 (FIG. 3) and is defined by side walls 13 and 14 and end wall 11. Space 31 extends from end wall 11 to the bottom end of inclined shelves 25 and 26. Lid 16 is spaced a distance or height 33 in area 31 from bottom wall 15. The second area 32 is defined between bottom wall 15 and lid 16 as the lid extends upwardly atop shelves 25 and 26 and more specifically beneath outlet 34 (FIG. 1) that extends through the inclined portion of lid 16.

Space 31 is provided for holding a palette that has paint thereon whereas area 32 is provided to hold a receptacle 40 (FIG. 3) that rests atop bottom wall 15. The receptacle 40 includes material 42 therein that when activated emits a gas heavier than oxygen. The emitted gas flows out of receptacle 40 and into space 31 and space 32 thereby forcing from the container via outlet 34, the lighter gases including oxygen. Lid 16 is located a distance or height 41 from bottom wall 15 at the location of area 32 and more specifically between bottom wall 15 and lid 16 at the location of hole 34. Distance 41 is greater than distance 33 allowing the oxygen within the air initially within the container to flow into area 32 and escape via the outlet 34 when the material within receptacle 40 is activated producing a gas heavier than oxygen.

In the preferred embodiment, the material 42 provided in receptacle 40 is powdered baking soda which is typically found in the household pantry. In order to activate the baking soda, vinegar is poured through outlet 34 being located immediately above receptacle 40. The acetic acid within the vinegar reacts with the sodium bicarbonate found in the baking soda to form carbonic acid. Carbonic acid falls apart into carbon dioxide and water. Since the carbon dioxide is heavier than oxygen, the carbon dioxide gas overflows receptacle 40 into areas 31 and 32 eventually forcing out the lighter gases including oxygen via outlet 34.

To facilitate pouring of the vinegar liquid into outlet 34, a conventional funnel 43 is removably inserted into aperture 34 with the bottom neck of the funnel having a bottom end spaced apart from and over receptacle 40. The wedge shaped upper portion of the funnel extends partially through aperture 34 and is removably wedged therein. In order to prevent all of the gas within the container from rushing out through the funnel, a marble ball 44 is loosely positioned within the upper wedge shaped interior cavity of funnel 43 thereby limiting the amount of gas escaping from the container. With the increased pressure within the container resulting from the reaction of the vinegar and baking soda, the ball is moved slightly away from the interior surface of the funnel limiting the amount of gas escaping from the container. Likewise, since the marble is loosely positioned within the funnel, it does not prevent the vinegar from being poured into the funnel and then moving between the marble and funnel into the container.

Figure 4:
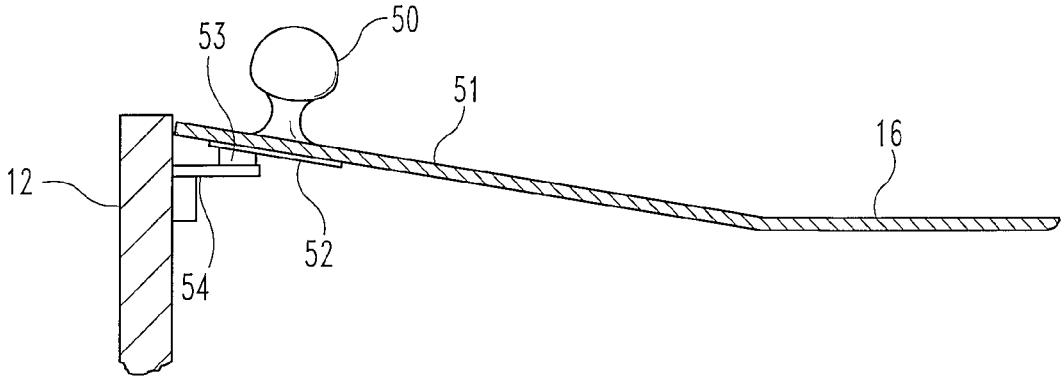
FIG. 4 is a fragmentary cross-sectional view taken along a line and viewed in the direction of arrows 4-4 of FIG. 1 showing the lid handle and latch.
Figure 5:
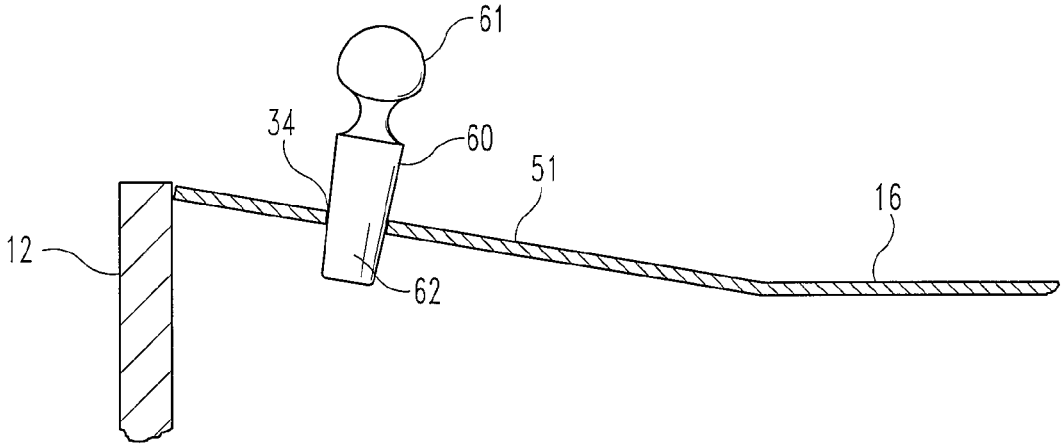
FIG. 5 is a fragmentary cross-sectional view showing the funnel removed from the lid and replaced by a stopper.

A handle 50 (FIG. 4) is fixedly mounted to the inclined portion 51 of lid 16. Immediately beneath handle 50 on the bottom facing surface of the inclined portion 51 of the lid is a metal plate 52 attached to handle 50. A magnet 53 is mounted by bracket 54 to end wall 12 of the main body of the container. Magnet 53 is positioned immediately beneath and adjacent plate 52 with the magnet and plate being operable to hold lid 16 to the main body of the container but releasable therefrom as handle 50 is pulled upwardly.

The palette container is used to prevent drying of the oil-based paints atop the palette positioned in the storage space 31 of the container. Lid 16 is first removed from the main body of the container by pulling upwardly handle 50 allowing the palette to be inserted in area 31. Receptacle 40 is then filled with baking soda and located beneath the bottom end of funnel 43 when the lid is mounted back onto the main body of the container. In order to provide an oxygen free atmosphere within storage spaces 31 and 32, vinegar is then poured into the funnel seeping between the marble ball and the funnel side walls. Within seconds, the vinegar activates the baking powder producing gas heavier than oxygen with the heavy gas filling storage spaces 31 and 32 and driving the lighter gases including oxygen out through funnel 43. The storage container therefore stores the palette limiting drying of the paint thereon for an extended period of time. Experiments have shown that oil-based paint on the palette will not dry within 32 days from the time the baking soda is activated.

A stopper 60 (FIG. 4) is provided to plug aperture 34 if it is desired to remove funnel 43 and marble ball 40 therefrom. A more secure gas tight environment within spaces 31 and 32 is provided by removing funnel 43 from the aperture and then inserting stopper 60; however, it is to be understood that excellent results have been obtained by leaving the funnel in place and not utilizing the optional stopper. The stopper 60 includes a head 61 for grasping and a main body 62 of resilient material such as rubber to engage the side surface of aperture 34.

Baking soda has been chosen as the material to place within receptacle 40 since it is a common household item and is initially a powdered material which when activated gives off a gas when vinegar is poured thereon. The space between the lid and main body of the container provides an air tight space except at the location of outlet 34 assuming aperture 34 is completely open with the weight of the lid compressing the gasket 30 atop the shelves and with the magnet engaged with the handle pulling the lid downward towards the bottom wall of the container.

In addition, the present container may be used to limit drying of oil-based paint on items, such as, sculptures, figurines, or any work that is in process wherein it is desirable to limiting the paint from drying until the work is complete. Thus, the container may be sized to accommodate the particular work to be stored within such that the oxygen is not present within the container.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A container for holding a palette and limiting drying of paint on the palette comprising:

a main body for holding a palette with paint thereon;

a lid mounted to said main body forming a container to store the palette therein with the container including an outlet to allow oxygen within the container to escape; and, a receptacle within said main body for holding material when activated to give off a gas heavier than oxygen forcing oxygen out of the container via said outlet limiting solidification of paint on the palette; and wherein:

said outlet includes a hole extending through said lid which is positioned over said receptacle through which a liquid may be poured onto said material and further comprising:

a funnel having a movable ball therein limiting escape of gas within said container, said funnel extending through said hole.

2. The container of claim 1 wherein said material contains sodium bicarbonate and said liquid is acidic.

3. A container for holding a palette and limiting drying of paint on the palette comprising:

a main body for holding a palette with paint thereon;

a lid mounted to said main body forming a container to store the palette therein with the container including an outlet to allow oxygen within the container to escape; and, a receptacle within said main body for holding material when activated to give off a gas heavier than oxygen forcing oxygen out of the container via said outlet limiting solidification of paint on the palette; and wherein: and wherein said main body has a bottom with a first area positioned beneath said outlet whereat said receptacle is located and a second area whereat said palette is locatable, said lid is spaced apart from said bottom a first distance at said first area and is spaced apart from said bottom a second distance at said second area with said first distance greater than said second distance allowing oxygen from the air within the container to concentrate in said first area and escape via said outlet when said material is activated producing a gas heavier than oxygen.

4. The container of claim 3 wherein said lid is sealed to said container providing an air tight container except at the location of said outlet.

5. The container of claim 4 and further comprising:

a funnel with a bottom end spaced apart from and over said receptacle allowing liquid to be poured into said receptacle activating said material and once activated allowing gas within said container to escape therefrom.

6. The container of claim 5 and further comprising a ledge extending inward in said main body to removably support said lid.

7. The container of claim 6 and further comprising:

a magnetic lock associated with said main body and said lid normally holding said lid onto said main body.

8. A storage compartment comprising:

a receptacle to hold an item with paint thereon:

a lid removably mounted to said receptacle forming a storage space therebetween;

a material holder positioned within said receptacle to hold a first material to give off a gas when activated by a second material when placed therein; and, an outlet to allow gas within said space to escape, and wherein:

said storage space includes a first area with a first interior height and a second area with a second interior height less than said first interior height, said material holder located within said first area to allow gas given off therefrom to force lighter gas within said space to escape said space via said outlet.

9. The storage compartment of claim 8 wherein:

said outlet leads from said first area.

10. The storage compartment of claim 9 wherein:

said outlet normally includes a funnel removably mounted to said lid and a ball within said funnel, and further comprising a stopper removably and sealingly mountable to said outlet when said funnel and ball are removed therefrom to provide cooperatively with said receptacle and lid a gas tight storage space.

11. The storage compartment of claim 10 wherein the item stored in the compartment is a palette.

12. A container for holding a palette and limiting drying of paint on the palette comprising:

a main body for holding a palette with paint thereon;

a lid on said main body forming a container to store the palette therein with the container including an outlet to allow oxygen within the container to escape; and, a receptacle within said main body for holding material when activated to give off a gas heavier than oxygen forcing oxygen out of the container via said outlet limiting solidification of paint on the palette; and wherein:

said main body has a bottom with a first area positioned beneath said outlet and a second area whereat said palette is locatable, said lid is spaced apart from said bottom a first distance at said first area and is spaced apart from said bottom a second distance at said second area with said first distance greater than said second distance allowing oxygen from the air within the container to concentrate in said first area and escape via said outlet when said material is activated producing a gas heavier than oxygen.

13. The container of claim 12 wherein:

said outlet includes a hole extending through said lid which is positioned over said receptacle through which a liquid may be poured onto said material.

14. The container of claim 12 wherein said material contains sodium bicarbonate and said liquid is acidic.

* * * * *